US010952490B2

(12) United States Patent
Bruce et al.

(10) Patent No.: US 10,952,490 B2
(45) Date of Patent: Mar. 23, 2021

(54) MECHANICAL LOCK SOLE STRUCTURE FOR BRAIDED FOOTWEAR

(71) Applicant: NIKE, Inc., Beaverton, OR (US)

(72) Inventors: Robert M. Bruce, Portland, OR (US); Eun Kyung Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 219 days.

(21) Appl. No.: 15/993,105

(22) Filed: May 30, 2018

(65) Prior Publication Data

US 2018/0343961 A1 Dec. 6, 2018

Related U.S. Application Data

(60) Provisional application No. 62/512,557, filed on May 30, 2017.

(51) Int. Cl.

| | |
|---|---|
| ***A43B 1/04*** | (2006.01) |
| ***A43B 5/02*** | (2006.01) |
| ***A43B 9/00*** | (2006.01) |
| ***A43B 23/02*** | (2006.01) |
| ***A43B 13/12*** | (2006.01) |
| ***A43B 13/22*** | (2006.01) |
| ***A43B 3/24*** | (2006.01) |
| ***A43B 13/26*** | (2006.01) |

(Continued)

(52) U.S. Cl.

CPC ..... *A43B 1/04* (2013.01); *A43B 3/244* (2013.01); *A43B 5/02* (2013.01); *A43B 5/185* (2013.01); *A43B 9/00* (2013.01); *A43B 13/12* (2013.01); *A43B 13/122* (2013.01); *A43B 13/223* (2013.01); *A43B 13/26* (2013.01); *A43B 23/0245* (2013.01); *A43B 23/042* (2013.01)

(58) Field of Classification Search

CPC .. A43B 1/04; A43B 3/244; A43B 9/00; A43B 5/185; A43B 13/122

USPC ..... 36/3 A

See application file for complete search history.

(56) References Cited

U.S. PATENT DOCUMENTS 5,832,636 A * 11/1998 Lyden ..... A43B 5/02 36/59 R
8,756,834 B1 * 6/2014 Halberstadt ..... A43B 13/04 36/59 R (Continued)

FOREIGN PATENT DOCUMENTS

WO 2016115156 A1 7/2016

OTHER PUBLICATIONS

Uniform: https://www.merriam-webster.com/dictionary/uniform.*

(Continued)

*Primary Examiner* — Jillian K Pierorazio
(74) *Attorney, Agent, or Firm* — Shook, Hardy and Bacon L.L.P.

(57) ABSTRACT

Present aspects are directed to a braided article of footwear comprising a mechanical lock structure. The braided upper comprises a tubular braided structure with a plurality of apertures. The midsole comprises a plurality of protruding studs that are configured to receive the plurality of apertures. The midsole receives the braided upper and the plurality of protruding studs extend below a bottom surface of the braided upper via the plurality of apertures, locking or securing the braided upper and midsole together, thereby creating a mechanical lock structure.

11 Claims, 11 Drawing Sheets

(51) Int. Cl.
*A43B 5/18* (2006.01)
*A43B 23/04* (2006.01)

(56) References Cited

U.S. PATENT DOCUMENTS

2002/0035796 A1* 3/2002 Knoche ..... B29D 35/142 36/59 R
2004/0148803 A1* 8/2004 Grove ..... A43B 7/14 36/103
2005/0188562 A1* 9/2005 Clarke ..... A43B 23/0245 36/15
2005/0198868 A1* 9/2005 Scholz ..... A43C 15/161 36/67 D
2008/0216357 A1* 9/2008 Fogg ..... A43B 13/026 36/25 R
2009/0183392 A1* 7/2009 Shane ..... A43B 3/26 36/97
2010/0107450 A1* 5/2010 Locke ..... A43C 15/161 36/134
2012/0255201 A1* 10/2012 Little ..... A43B 1/04 36/84
2013/0160328 A1* 6/2013 Hatfield ..... A43B 13/141 36/103
2015/0007451 A1* 1/2015 Bruce ..... A43B 23/0295 36/83
2015/0223552 A1* 8/2015 Love ..... D04B 1/22 36/134
2015/0230546 A1* 8/2015 Zasloff ..... A43B 23/027 36/30 R
2016/0206039 A1* 7/2016 Cross ..... D04B 1/22
2016/0206040 A1* 7/2016 Cross ..... A43C 15/16
2016/0206042 A1* 7/2016 Cross ..... G06Q 30/0633
2016/0206044 A1* 7/2016 Dimoff ..... A43C 15/10
2016/0206046 A1* 7/2016 Cross ..... A43B 23/0205
2016/0206048 A1* 7/2016 Weidl ..... A43B 13/223
2016/0295971 A1* 10/2016 Arnese ..... B29D 35/0009
2017/0303627 A1* 10/2017 Weidl ..... A43B 3/244

OTHER PUBLICATIONS

International Search Report and Written Opinion dated Sep. 18, 2018 in International Patent Application No. PCT/US2018/035141, 17 pages.
International Preliminary Report on Patentability dated Dec. 12, 2019 in International Patent Application No. PCT/US2018/035141, 10 pages.

* cited by examiner

MECHANICAL LOCK SOLE STRUCTURE FOR BRAIDED FOOTWEAR

CLAIM OF PRIORITY

This application, having U.S. Non Provisional Application No. 15/933,105, filed on May 30, 2018 and entitled "Mechanical Lock Sole Structure For Braided Footwear," claims priority to U.S. Provisional Patent Application No. 62/512,557, filed May 30, 2017, and entitled "Mechanical Lock Sole Structure For Braided Footwear," the entirety of which is incorporated herein by reference.

FIELD OF THE INVENTION

The present invention relates to articles of footwear, and in particular, a mechanical lock sole structure for a braided article of footwear.

BACKGROUND

Traditional shoes are often made from textiles or materials that have uppers that are cut to a desired shape and stitched together. Newer methods also now include forming shoe uppers from a knitted textile. Still newer methods involve braiding a tubular textile for use as the shoe upper. Aspects herein relate to braiding tubular structures that in some aspects are used in articles of footwear.

SUMMARY

An article of braided footwear having a mechanical lock sole structure and a braided upper is provided. Some aspects generally include a braided upper and an integrated sole structure that mechanically engages at least a portion of the braided upper, such as a locking midsole having a bottom surface keyed with surface features that interact with a shoe bottom and/or shoe side surface of the braided upper. The integrated midsole may engage at least a portion of the braided upper by extending through a plurality of mesh-like braided apertures of the braided upper and into contact with a ground surface, providing outsole functionality in addition to midsole support. Additionally, based on engaging a perimeter of each sole surface feature with a corresponding and surrounding braid aperture, in some aspects, an interlocked sole and braided upper may become stabilized into a secured/keyed position within the braided upper.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative aspects of the present invention are described in detail below with reference to the attached drawing figures, which are incorporated by reference herein and wherein.

DETAILED DESCRIPTION

Figure 1:
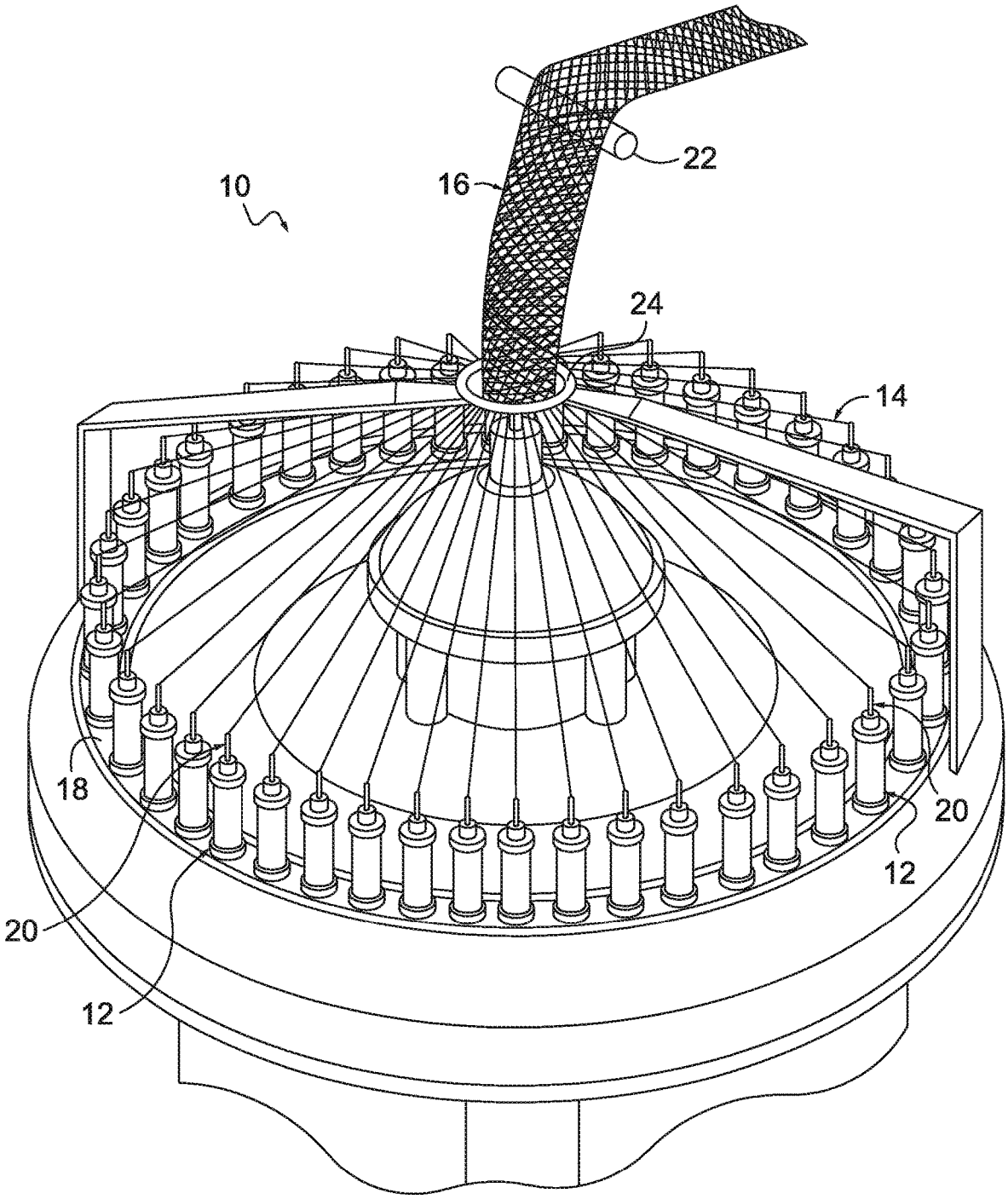
FIG. 1 depicts a schematic view of an exemplary braiding machine, in accordance with aspects herein.

The subject matter of the present invention is described with specificity herein to meet statutory requirements. However, the description itself is not intended to limit the scope of this patent.

Generally, articles of footwear have two major components, an upper that provides the enclosure for receiving the foot and a sole secured to the upper. The upper may be adjustable using laces, hook-and-loop fasteners, or other devices to secure the shoe to the foot. The upper may further be engineered to provide the appropriate type of protection to the foot and to maximize the wearer's comfort. A sole may comprise a midsole and an outsole. The outsole portion usually has primary contact with the ground and may be designed to absorb shock as the footwear contacts the ground or other surfaces.

In the aspects discussed herein, the article of footwear is in the form of different athletic shoes. However, in some other aspects, the provisions discussed herein for the braided article of footwear could be incorporated into various other kinds of footwear including, but not limited to, basketball shoes, hiking boots, soccer shoes, football shoes, sneakers, running shoes, cross-training shoes, and other types of footwear. Moreover, in some aspects, the provisions discussed herein for an article of footwear could be incorporated into various other kinds of non-sports related footwear, including, but not limited to slippers, sandals, high heeled footwear, loafers, as well as other kinds of footwear.

At a high level, aspects herein are directed to a braided article of footwear that comprises a flexible shoe sole that is secured to the braided upper. A braided upper is defined as a unitary braid structure manufactured using a braiding technique. Braiding is the process of interlacing or interweaving three or more yarns diagonally to a product axis in order to obtain a thicker, wider or stronger product or in order to cover (overbraid) some profile. Interlacing diagonally means that the yarns make an angle with the product axis, which can be between 1° and 89° but is usually in the range of 30°-80°. This angle is called the braiding angle. Braids can be linear products (ropes), hollow tubular shells or solid structures (one, two or three-dimensional textiles) with constant or variable cross-section, and of closed or open appearance.

As used herein, the yarns used for braiding may be formed of different materials having different properties. The properties that a particular yarn will impart to an area of a braided component partially depend upon the materials that form the yarn. Cotton, for example, provides a softer product, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarn selected for formation of a braided component may affect the properties of the braided component. For example, a yarn may be a monofilament or a multifilament. The yarn may also include separate filaments that are each formed of different materials. In addition, the yarn may include filaments that are each formed of two or more different materials, such as a bicomponent yarn with filaments having a sheath-core configuration or two halves formed of different materials.

By using a braiding technique, the articles of footwear may be engineered with specific features tailored to a particular athletic or recreational activity and are characterized by close containment over the wearer's foot. Different regions of the braided upper may have different braided configurations. For example, higher braid densities may be used in specific areas of the footwear to provide additional structural support or compression. The different braid densities are incorporated with one another to form a seamless braided upper. The term braided density refers to the number and/or concentration of the particular yarn used in braiding the different regions and is measured by the number of yarn interlacings per unit area. Additionally, yarns of different material may be incorporated in different regions of the braided upper to provide specific properties to the footwear in those areas. For example, yarns made of material with a greater tensile strength may be used in sections of the footwear that undergo higher stress during a specific activity. Softer and more pliable yarns may be used in sections of the footwear that are not subject to high stress, to provide a more comfortable and closely-fitting upper in those sections. Further, the different braid densities may vary in structural properties such as the number of yarns in the braid, the diameter of one or more yarns of the braid, the density of the yarns, and the material properties of the yarns such as elasticity, rigidity, tensile strength, compressibility, and other material properties.

The braided upper formed using a braiding technique is secured to the sole structure which extends between the foot and the ground when the article is worn. In different aspects, the sole structure may include different components. For example, a sole structure may include a midsole only or a midsole and an outsole. Sole structures may also provide one or more functions for the article. For example, a sole structure may be configured to provide traction for an article when worn. Additionally, the midsole may include a polymer foam material that attenuates ground reaction forces when compressed between the foot and the ground during walking, running, or other ambulatory activities. The midsole may also be made of relatively soft material to provide cushioning. The outsole is generally made of harder, more abrasion resistant material such as rubber or EVA. The outsole is secured to a lower surface of the midsole and provides a ground-engaging portion of the sole structure formed from a durable and wear-resistant material, such as rubber.

The figures depict articles of footwear with braided uppers comprising a braided tubular structure with a plurality of apertures on the bottom surface of the braided upper. The braided upper extends beneath the foot of the wearer, thereby providing 360-degree containment around the bottom of the foot. The midsole comprises a plurality of protruding studs that are keyed to receive the plurality of apertures of the braided upper. In other words, the plurality of apertures of the braided upper and the plurality of protruding studs are configured so that the plurality of protruding studs fit through the plurality of apertures and extend below the bottom surface of the plurality of apertures of the braided upper. When the plurality of studs of the midsole receive the plurality of apertures of the braided upper, at least one of the plurality of apertures encircles the plurality of protruding studs to provide 360-degree containment. Additionally, each of the plurality of studs comprises at least one ground-contact outer surface that extends below the bottom surface of the braided upper. The at least one ground-contact outer surface comprises a non-compressible material that maintains a primary configuration upon ground contact. Further, the plurality of protruding studs of the midsole may comprise all or a portion of the midsole.

In some aspects, a mechanical lock sole structure may include an interlocking midsole having one or more surface features keyed to a sole portion of a braided upper. For example, a midsole may include multiple protruding studs along a bottom surface of the midsole. In further aspects, the midsole material may include various materials that provide cushioning, such as polyurethane foam, compression-molded EVA, leather or polyurethane.

In one aspect, a uniform size, spacing, height, and/or dimension may be associated with the plurality of protruding studs on the midsole. In other aspects, the plurality of protruding studs may vary in size, spacing, height, dimension, location, and/or configuration on the midsole depending on the type of footwear. For example, in certain athletic shoes, the plurality of protruding studs may be located in a specific pattern to aid in directional movement when worn and may consist of one or more shapes. The plurality of apertures in the braided upper structure are keyed to mate to the plurality of protruding studs and may correspond to the circumference of a particular protruding stud. For example, a hexagonal protruding stud extending from a bottom surface of the midsole may correspond to a hexagonal aperture in the braid structure.

In one aspect, the midsole may be pre-molded with the plurality of protruding studs prior to being received by the plurality of apertures of the braided upper. In other aspects, the midsole compromises a co-molded midsole associated with the braided upper during the three dimensional assembly processes, wherein the co-molded midsole comprises a flexible joining with the braided upper. In yet another aspect, the braided article of footwear comprises a sprayed outsole. The sprayed outsole comprises a spray component which is applied to both the plurality of studs extending below the bottom surface of the braided upper and the bottom surface of the braided upper. In this aspect, the outsole is sprayed onto the plurality of studs and the bottom surface of the braided upper after the outsole and bottom surface of the braided upper are "locked" together. The spray component applied may, for example, comprise a sprayed polyurethane, which provides an additional covering to the article of footwear and strengthens the flexible joining of the midsole and braided upper.

In yet another aspect, the braided upper comprises a tubular braided structure and a plurality of apertures and the midsole comprises a planar surface comprising a plurality of braid-receiving features that mate to the plurality of apertures. The braided upper and midsole are secured together based on the plurality of apertures coupling to the plurality of braid receiving features. In some aspects, an outsole may also be coupled to the braided upper and midsole.

In yet another aspect, the braided article of footwear comprises a braided upper and a midsole. The braided upper comprises a tubular braided structure and a plurality of apertures. The plurality of apertures are keyed to surround the plurality of protruding studs of a midsole when secured together to provide 360-degree containment of the protruding studs.

As stated above, braided structures can be formed as tubular braids on a braiding machine, such as a radial, axial or lace braiding machine. One example of a lace braiding machine can be found in Ichikawa, EP 1 486 601, granted May 9, 2007, entitled "Torchon Lace Machine" and EP No. 2 657 384, published Oct. 30, 2013 entitled "Torchon Lace Machine," the entirety of which are hereby incorporated by reference. The upper portion of an exemplary braiding machine 10 is shown in FIG. 1. Braiding machine 10 includes a plurality of spools 12. In some aspects, the spools 12 carry the yarn 14 selected for braiding. The yarns 14 from individual spools 12 are selectively interlaced or intertwined with one another by the braiding machine 10. This interlacing or intertwining of strands forms a braided structure 16, as further described below. Each of the spools 12 is supported and constrained by a track 18 about the circumference of the braiding machine 10. Each spool 12 has a tensioner 20 (shown schematically in FIG. 1) that operates, along with a roller 22, to maintain a desired tension in the yarns 14 and the braided structure 16. As the yarns 14 extend upwardly, they pass through a braid ring 24 that is generally considered the braiding point. The braiding point is defined as the point or area where yarns 14 consolidate to form braid structure 16. At or near ring 24, the distance between yarns 14 from different spools 12 diminishes. As the distance between yarns 14 is reduced, the yarns 14 intermesh or braid with one another in a tighter fashion and are pulled linearly by roller 22.

Figure 2:
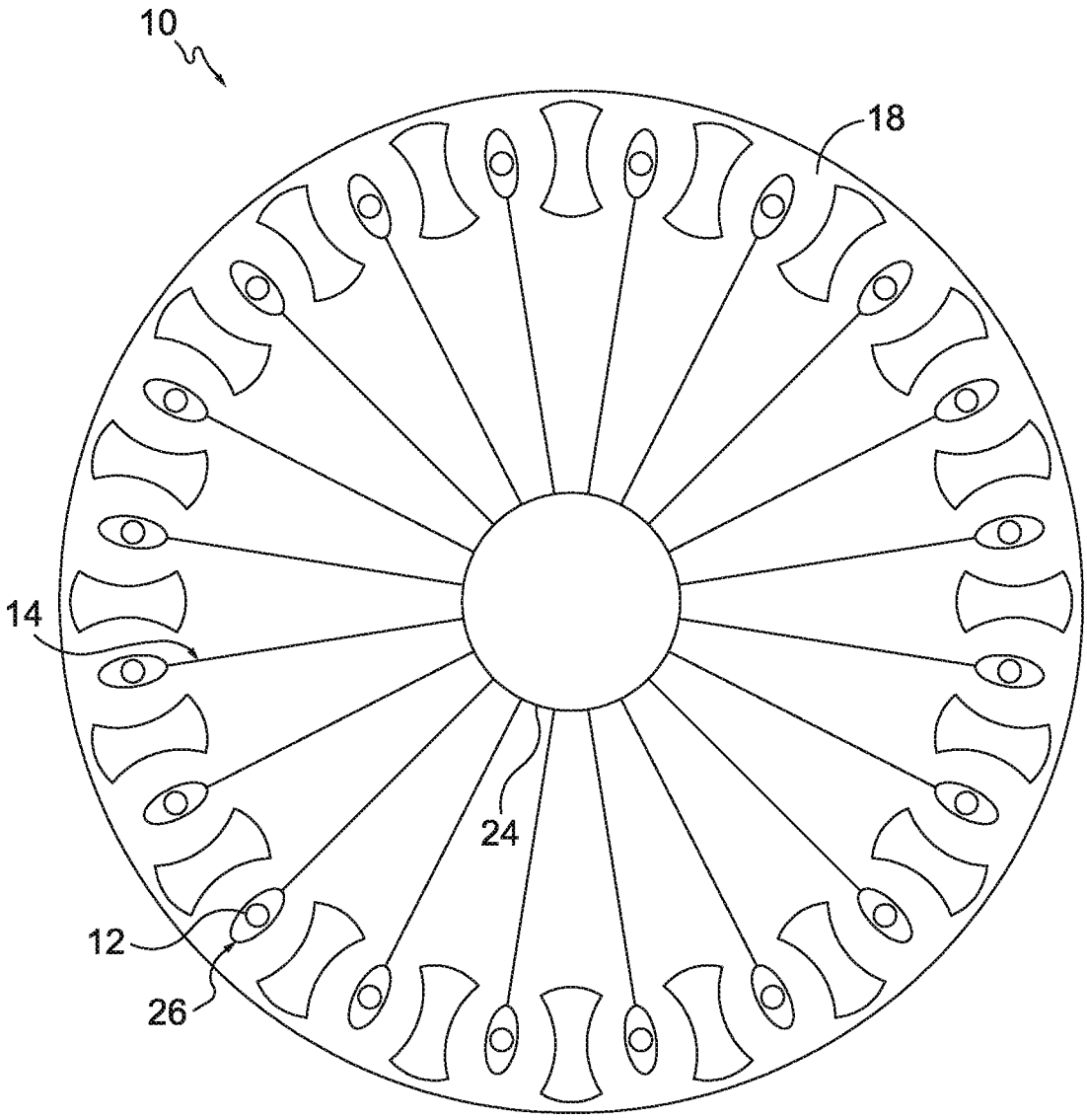
FIG. 2 depicts a schematic top view of an exemplary braiding machine, illustrating the carriages and rotor metals, in accordance with aspects herein.
Figure 3:
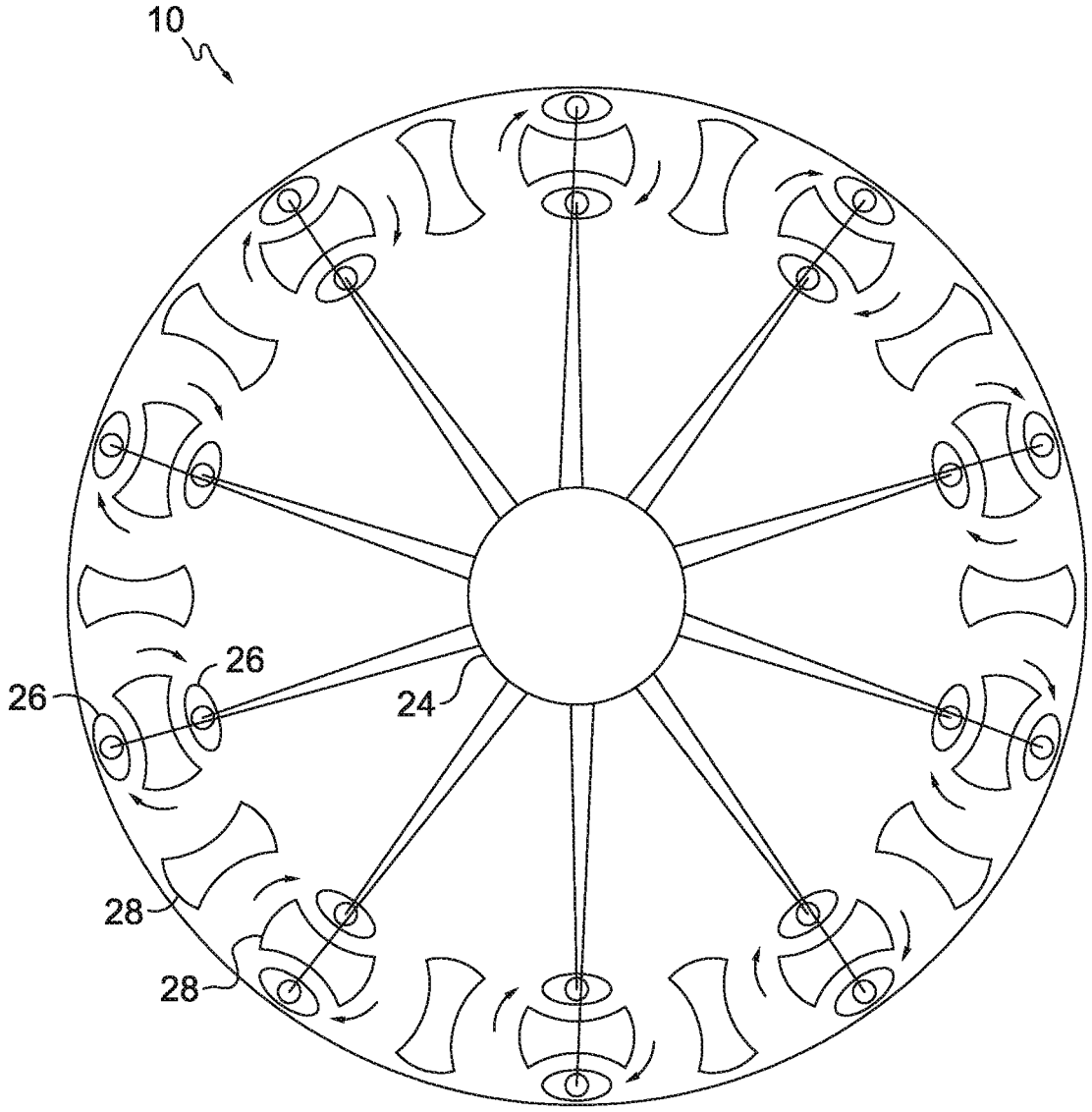
FIG. 3 depicts a view similar to FIG. 2, but with the rotor metals moving the carriages, in accordance with aspects herein.
Figure 4:
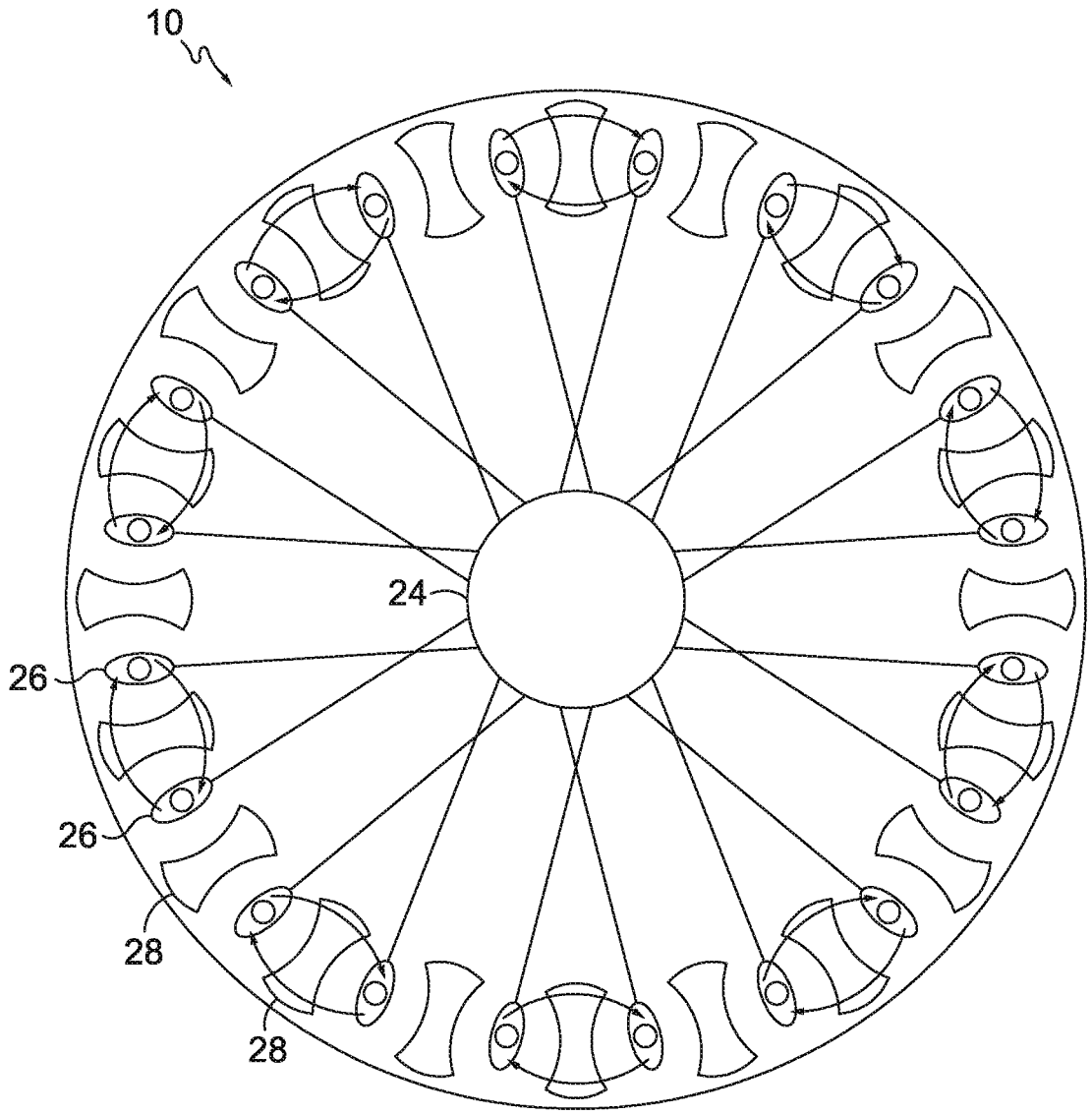
FIG. 4 depicts a view similar to FIG. 3, but showing the completion of the exemplary movement of FIG. 3, in accordance with aspects herein.

As best seen in FIGS. 2 and 3, each spool 12 is carried and supported by a carriage 26. Each spool 12 is movable about the circumference of the track 18 by rotor metals 28. As described on the Torchon Lace Machine referenced previously, and disclosed in EP 1 486 601, each of the rotor metals 28 can be moved clockwise or counterclockwise. In contrast to radial braiding machines or fully non-jacquard machines, in a lace braiding machine, each rotor metal is not intermeshed with the adjacent rotor metal. Instead, each rotor metal 28 may be selectively independently movable. As can be seen by comparing FIG. 3 to FIG. 4, as the rotor metals 28 rotate, they move the carriages 26, and thus the spools 12 supported on the carriages 26 by moving them about the circumference of the track 18. The braiding machine 10 is programmable such that the individual rotor metals 28 rotate the carriages 26, and thus the spools 12 to move them about the circumference of the track 18. As an individual spool 12 moves relative to an adjacent spool 12, the yarns 14 carried on the spools 12 interweave to create a desired braid pattern. The movement of spools 12 may be pre-programmed to form particular shapes, designs, and thread densities of a braided component or portions of a braided component. By varying the rotation and location of individual spools 12, various braid configurations may be formed. Such an exemplary braiding machine may form intricate braid configurations including both jacquard and non-jacquard braid configurations or geometries. Such configurations and geometries offer design possibilities beyond those offered by other textiles, such as knitting.

In some aspects, the size of braiding machine 10 may be varied. It should be understood that the braiding machine 10 shown and described is for illustrative purposes only. In some aspects, braiding machine 10 may be able to accept 144 carriages, although other sizes of braiding machines, carrying different numbers of carriages and spools is possible and is within the scope of this disclosure. By varying the number of carriages and spools within a braiding machine, the density of the braided structure as well as the size of the braided component may be altered.

Figure 5:
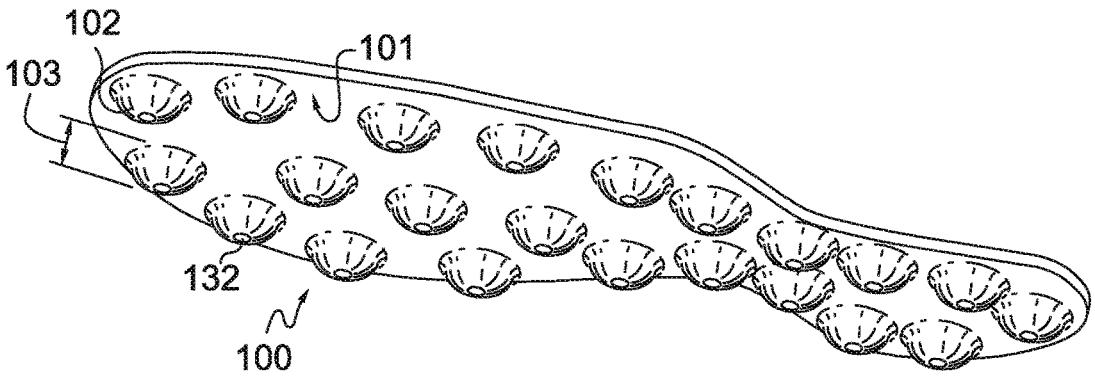
FIG. 5 depicts a perspective view of an exemplary midsole, in accordance with aspects herein.
Figure 6:
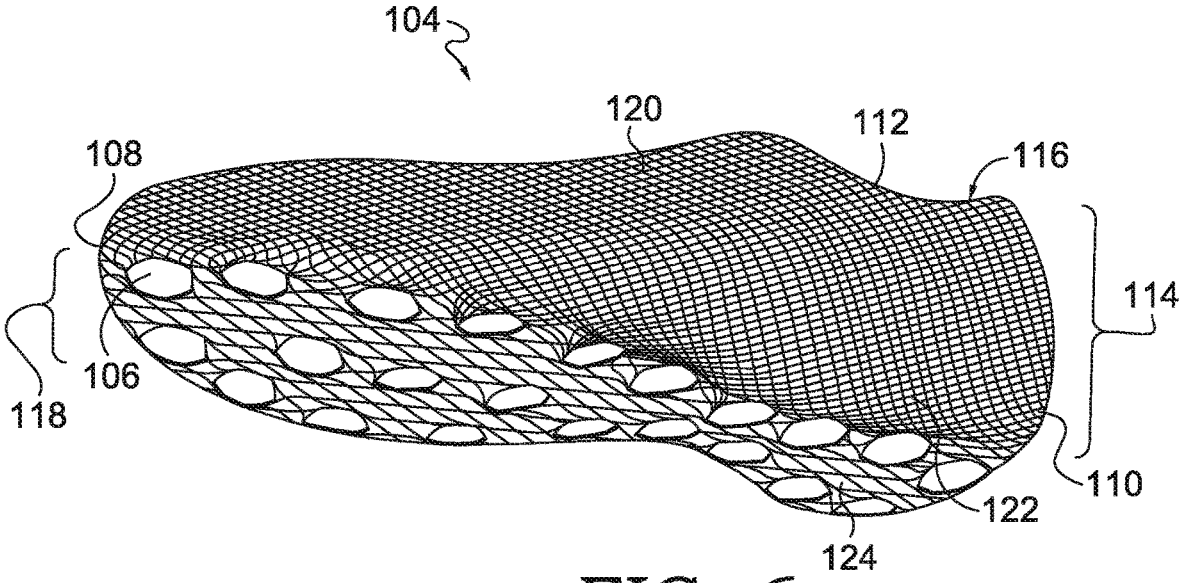
FIG. 6 depicts a side perspective view of an exemplary braided upper comprising a tubular braided structure and a plurality of apertures, in accordance with aspects herein.
Figure 7:
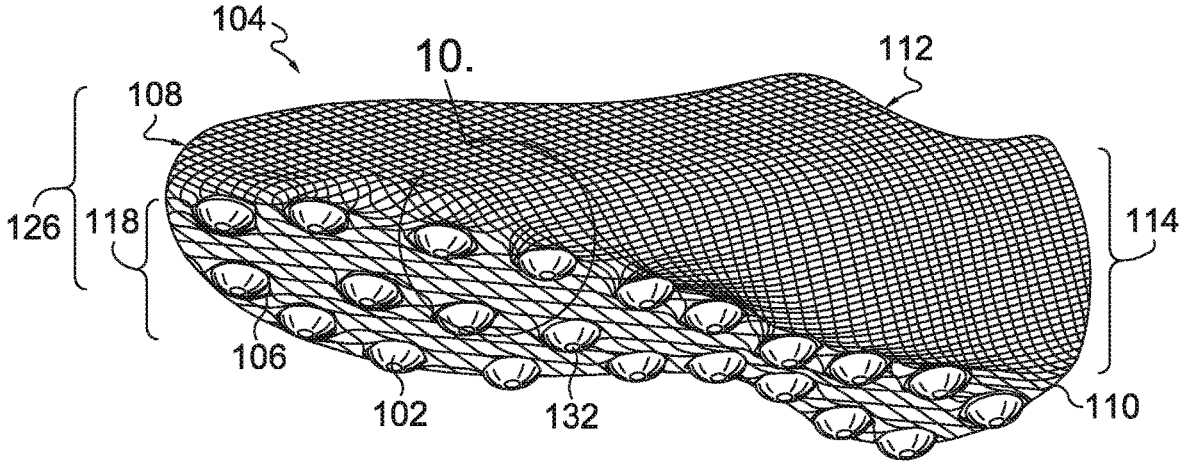
FIG. 7 depicts a side perspective view of an exemplary braided article of footwear, in accordance with aspects herein.

Turning now to FIGS. 5-10, aspects of a mechanical lock sole structure of a braided article of footwear include a braided upper 104 (FIG. 6) and a midsole 100 (FIG. 5) that are coupled together to form a braided article of footwear 126 (FIG. 7). As seen in FIG. 5, the midsole 100 includes a plurality of spaced, protruding studs 102 extending from a bottom surface 101 of the midsole 100. The studs 102 may vary in location, spacing, shape, height, and width, depending on the article of footwear. For example, as shown in FIG. 5, the protruding studs 102 are of a generally partial spherical shape extending from the bottom surface 101. However, in an alternative aspects such as a soccer cleat, the geometry of the protruding studs 102 on the midsole 100 may be conical instead to help with multi-directional movements. Further, the midsole 100 may include more than one geometry of protruding studs 102. For example, the bottom surface 101 of the midsole 100 for soccer cleats may include conical, chevron (inverted V shape), and other geometries of protruding studs 102.

The protruding studs 102 extend a particular distance 103 below the midsole 100 depending on the location of the stud, shape of the stud, and type of article of footwear. In some aspects, each protruding stud 102 has at least one ground-contact outer surface 132. It is also contemplated that the protruding studs 102 may cover all or a portion of the bottom surface 101 of the midsole 100. In FIG. 5, the protruding studs 102 are uniformly located across the bottom surface 101 of the midsole 100. However, the protruding studs 102 may be located in any location or configuration across all or portions of the bottom surface 101 of the midsole 100. In some aspects, the protruding studs 102 are pre-molded or co-molded with the midsole 100.

FIG. 6 depicts a side perspective view of the braided upper 104 of the braided article of footwear 126. The braided upper 104 comprises a tubular braided structure 114 with an ankle opening 112, a toe end 108 opposite a heel end 110, an internal cavity 116, and a bottom surface 118. The tubular braided structure 114 has a braid configuration in at least one area defining a plurality of apertures 106 that correspond in location, size, and shape to the protruding studs 102 of the midsole 100 depicted in FIG. 5.

The tubular braided structure 114 is a unitary braided structure when formed as a one-piece element through a braiding process, which forms the various features and structures of the braided component without the need for significant additional manufacturing steps or processes. The density and composition of the braiding of the braided upper 104 may vary from the top portion 120 of the braided upper 104 to the bottom surface 118 of the braided upper 104, resulting in zonal braiding where the density of the braid changes in different areas of the braided upper or from zone-to-zone. The braided upper 104 depicted in FIG. 6 is merely one example of a braid pattern. However, it is contemplated that the braided upper may comprise various braided configurations based on the type of footwear. For example, in FIG. 6, the braid configuration comprises a dense braid on the top portion of the braided upper at 120. The braid then transitions to a slightly wider braid 122 on the sides of the braided upper, and further transitions to an even wider braid 124 on the bottom surface 118 of the braided upper 104 where the plurality of apertures 106 are located. While the density of the braiding may vary in different areas of the braided upper, the braided upper 104 is one continuous braided tubular structure 114 as depicted in FIG. 6. The varying density of the tubular braid structure 114 may be engineered to provide the appropriate level of structural stability, support, durability, and comfort.

Figure 8:
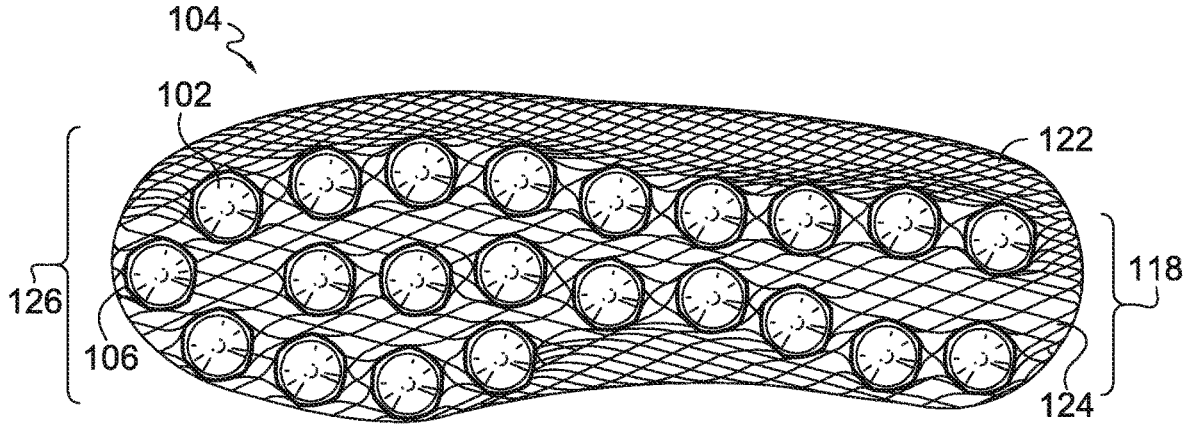
FIG. 8 depicts a bottom view of the exemplary braided article of footwear of FIG. 7, in accordance with aspects herein.

FIGS. 7 and 8 illustrate the combination of the midsole 100 and the braided upper 104, forming the braided article of footwear 126. As shown in FIGS. 7-10, the midsole 100 from FIG. 5 is in engagement with the braided upper 104 from FIG. 6. In this condition, the studs 102 of midsole 100 extend though the defined apertures 106 of braided upper 104. When the midsole 100 engages the braided upper 104, the yarns of the braid configuration defining the apertures 106 provide 360-degree containment around the corresponding protruding studs 102, as best seen in FIG. 10. This containment "locks" the braided upper 104 into the midsole 100.

FIG. 8 illustrates a bottom perspective view of the braided article of footwear 126 of FIG. 7. As seen in FIG. 8, in some aspects the braided upper 104 has a tighter, denser braid configuration at 122 and a less dense braid configuration at 124. The wider braiding found at the bottom surface 118 of the braided upper 104 creates, at least in part, the apertures 106 through which protruding studs 102 extend to provide 360-degree containment.

Figure 9A:
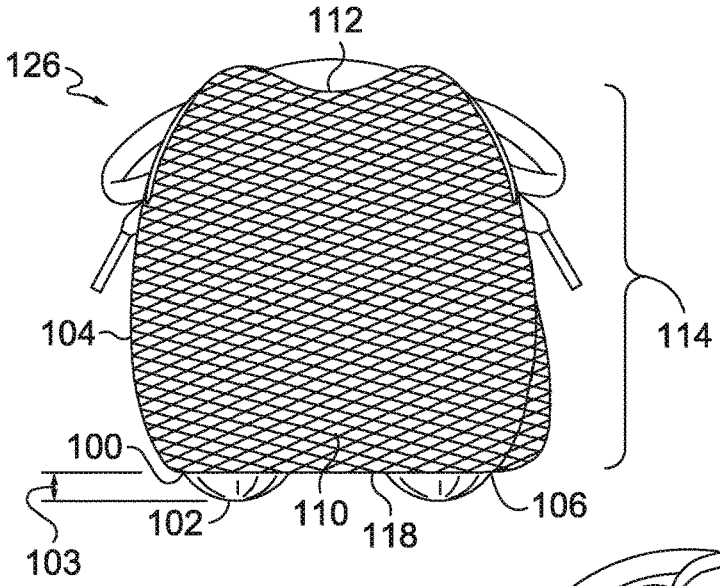
FIG. 9A depicts a rear view of the exemplary braided article of footwear of FIG. 7 at the heel end, in accordance with aspects herein.
Figure 9B:
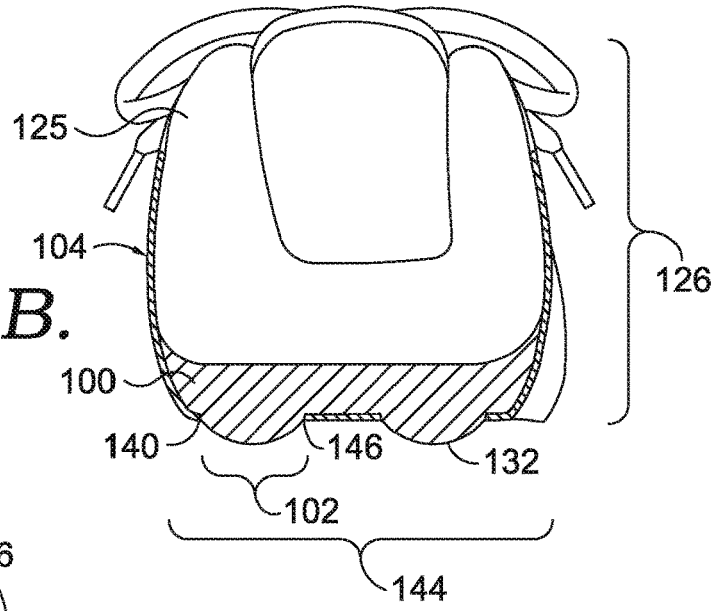
FIG. 9B depicts a cross-sectional view of FIG. 9A, in accordance with aspects herein.
Figure 10:
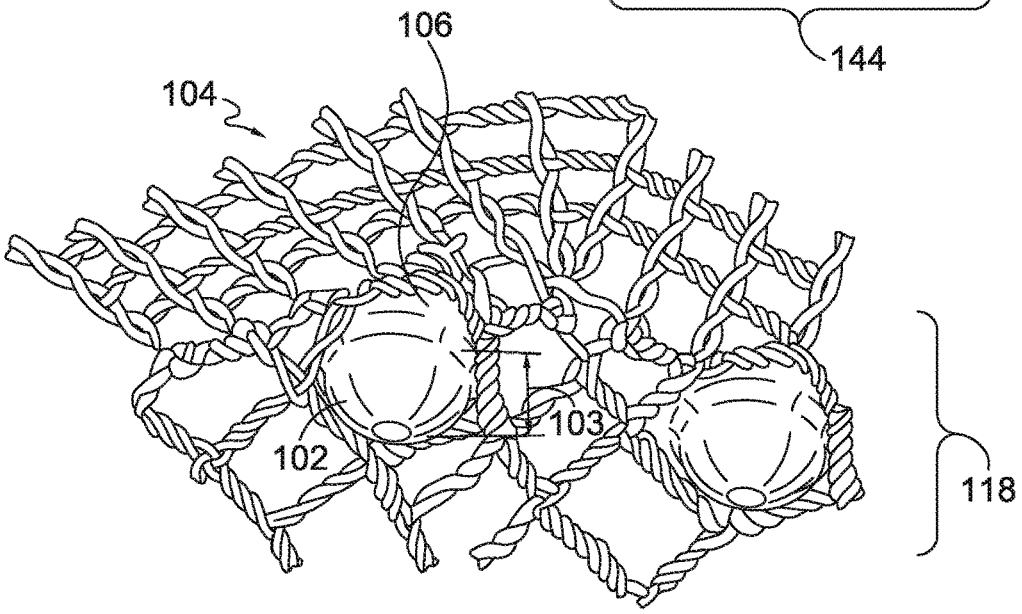
FIG. 10 depicts a close-up view of a portion of the exemplary braided article of footwear of FIG. 7, in accordance with aspects herein.

FIG. 9A depicts a rear view of the braided article of footwear 126 at the heel end 110. FIG. 9B is a cross-section of FIG. 9A, showing the midsole 100 and the protruding studs 102 extending through the bottom surface 118 of the braided upper 104. As shown in FIGS. 9A and 9B, in some aspects, at least a portion of the braided upper 104 defined by the apertures 106 abuts a circumference of each of the plurality of protruding studs 102 as seen at 140 and 146. The relationship between the apertures 106 of the braided upper 104 and the protruding studs 102 of the midsole 100 is also shown in the enlarged view of FIG. 10.

Figure 11A:
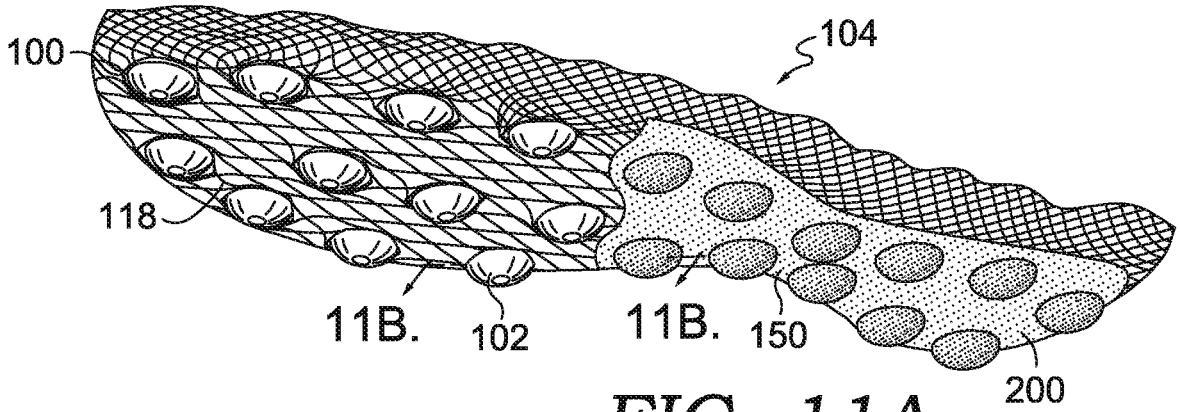
FIG. 11A depicts a perspective view of the exemplary braided article of footwear of FIG. 7 with a sprayed outsole covering a portion of the midsole and bottom surface of the braided upper, in accordance with aspects herein.
Figure 11B:
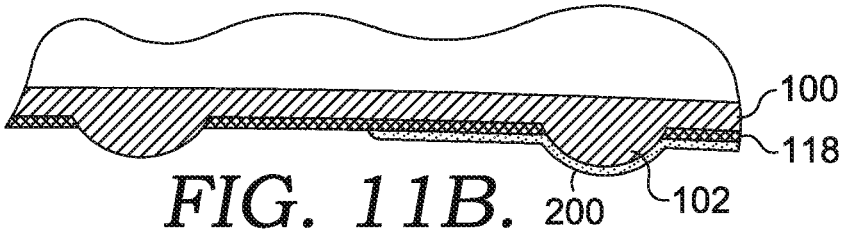
FIG. 11B depicts a cross-section view of FIG. 11A taken at cut line 11B-11B, in accordance with aspects herein.

FIGS. 11A-11B illustrate an additional aspect in which an outsole 200 is applied to the bottom surface 118 of the braided upper 104 and the protruding studs 102 of the midsole 100. In one aspect, the outsole 200 comprises a component 150 that is applied to both the protruding studs 102 extending below the bottom surface 118 of the braided upper 104, and the bottom surface 118 of the braided upper 104. In an exemplary aspect, component 150 can be applied as a spray. As described above, the component 150 may comprise a polyurethane material or any other suitable component for an outsole. FIG. 11B is a cross-section view of FIG. 11A and depicts the outsole 200 that has been applied to both the protruding studs 102 extending from the bottom surface 101 of the midsole 100 and the bottom surface 118 of the braided upper 104.

Figure 12A:
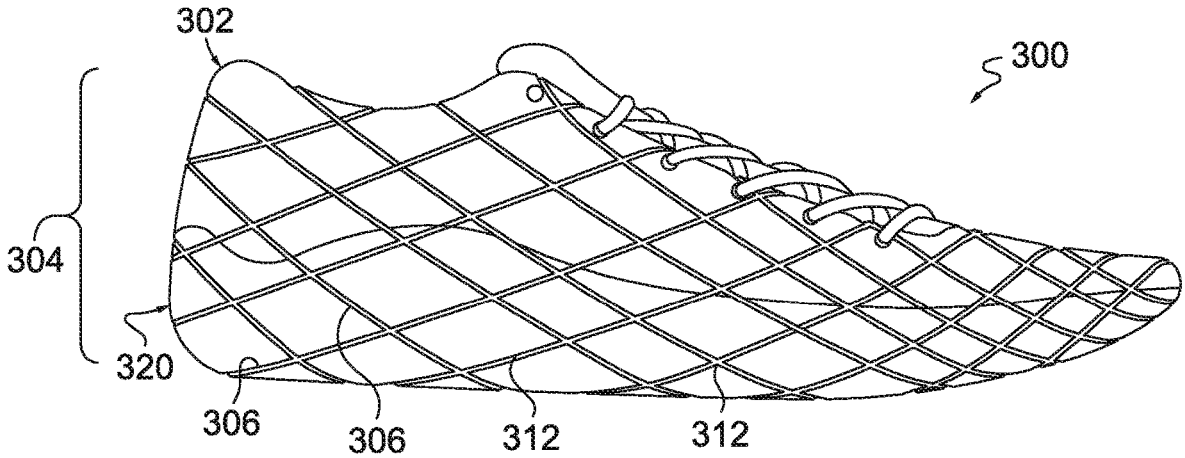
FIG. 12A depicts a side-view of an exemplary braided article of footwear, in accordance with aspects herein.
Figure 12B:
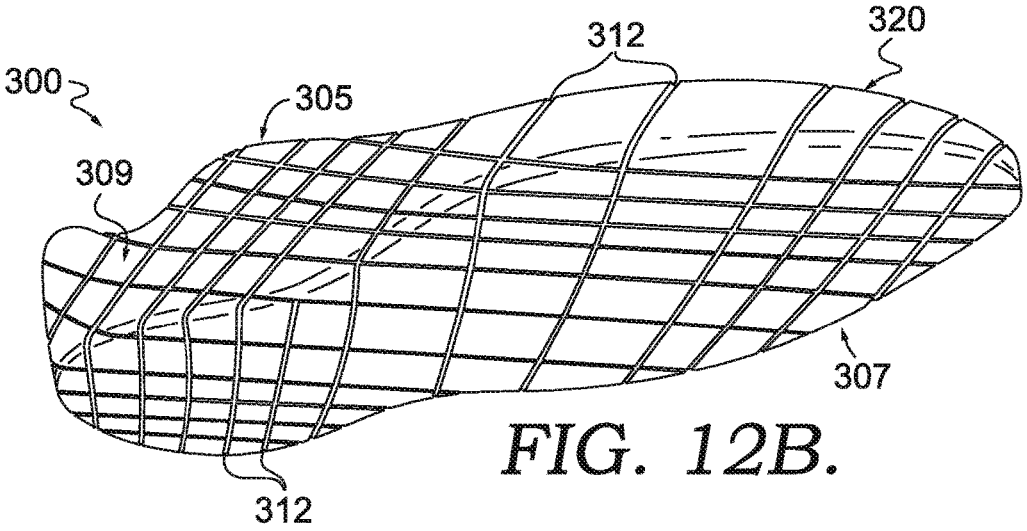
FIG. 12B depicts a perspective view of the exemplary braided article of footwear of FIG. 12A, in accordance with aspects herein.
Figure 13:
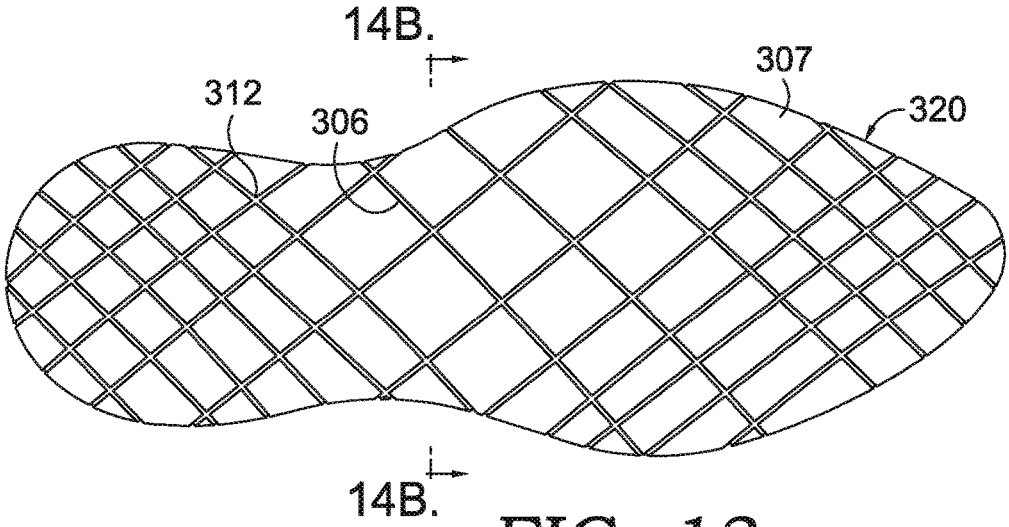
FIG. 13 depicts a bottom view of the exemplary braided article of footwear of FIG. 12A, in accordance with aspects herein.

FIGS. 12-14 illustrate additional aspects of a mechanical lock sole structure of a braided article of footwear. FIG. 12A illustrates a side perspective view of a braided article of footwear 300, shown without an outsole. In this configuration, a braided upper 302 comprises a tubular braided structure 304 that defines a plurality of apertures 306. For clarity, the braid configuration of braided upper 302 is shown schematically. It should be understood that any number of braid configurations could be used. At least a portion of the braided upper 302 has a braid configuration defining apertures 306. Apertures 306 are shown in a generally diamond shape, but could be any of a number of other shapes as well. The braided upper 302 is shown in FIG. 12A in engagement with a midsole 320, which is further described with respect to FIG. 12B. As best seen in FIG. 12B the midsole 320 extends from the top 305 to a bottom surface 307, spaced from one another by a side wall 309. Midsole 320 includes a number of spaced apart braid receiving features 312. In one aspect, braid receiving features 312 are formed as grooves extending into the midsole 320. As shown in FIGS. 12A and 12B, the braid receiving features 312 can be formed on the bottom surface 307 as well as the side wall 309.

FIG. 13 illustrates the bottom view of the braided article of footwear of FIG. 12A. As can be seen in FIGS. 12A and 13, the apertures 306 of the braided upper 302 are positioned to correspond with braid receiving features 312 on midsole 320. When midsole 320 is placed within the braided upper 302, the braid receiving features 312 receive, in at least some locations, the yarn of the braided upper 302, such that the apertures 306 mate with the braid receiving features 312. In this construction, the braided upper 302 is keyed into the midsole 320.

Figure 14A:
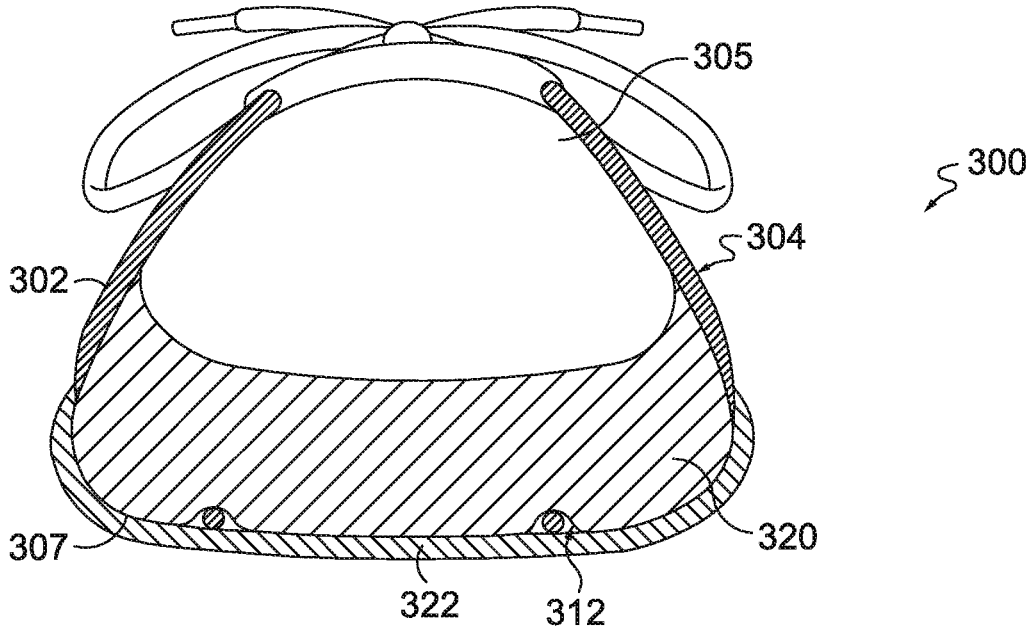
FIGS. 14A and 14B depict cross-sectional views of FIG. 13, in accordance with aspects herein.
Figure 14B:
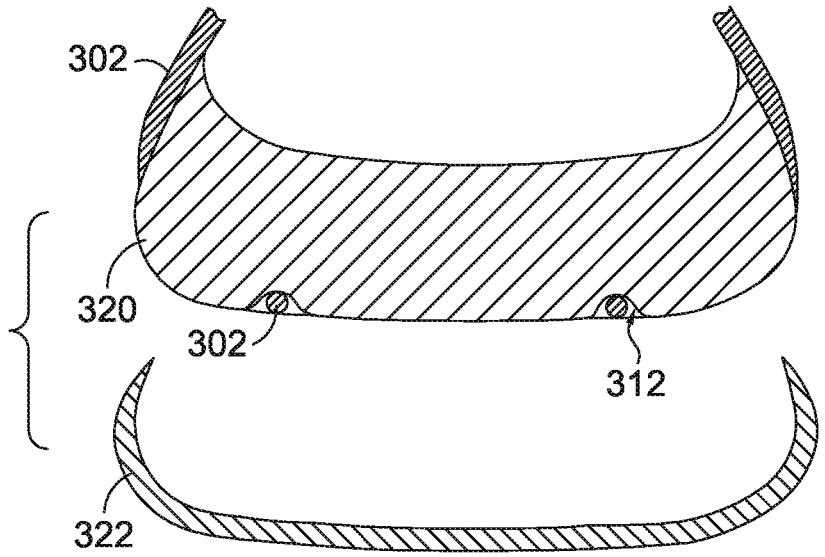

FIG. 14B illustrates a cross-section of FIG. 13. The braided upper 302 extends around the midsole 320. In addition, portions of the braided upper 302, namely the braided structure around apertures 306, fit within at least some of the braid receiving features 312. This may include, for example, braid receiving features 312 on either the bottom surface 307 or the side walls 309, or both. FIG. 14B also depicts an outsole 322 that can be coupled to the combined braided upper 302 and midsole 320, in some aspects. FIG. 14A illustrates the structure of FIG. 14B, with the outsole 322 coupled to the midsole 320 and braided upper 302.

Figure 15:
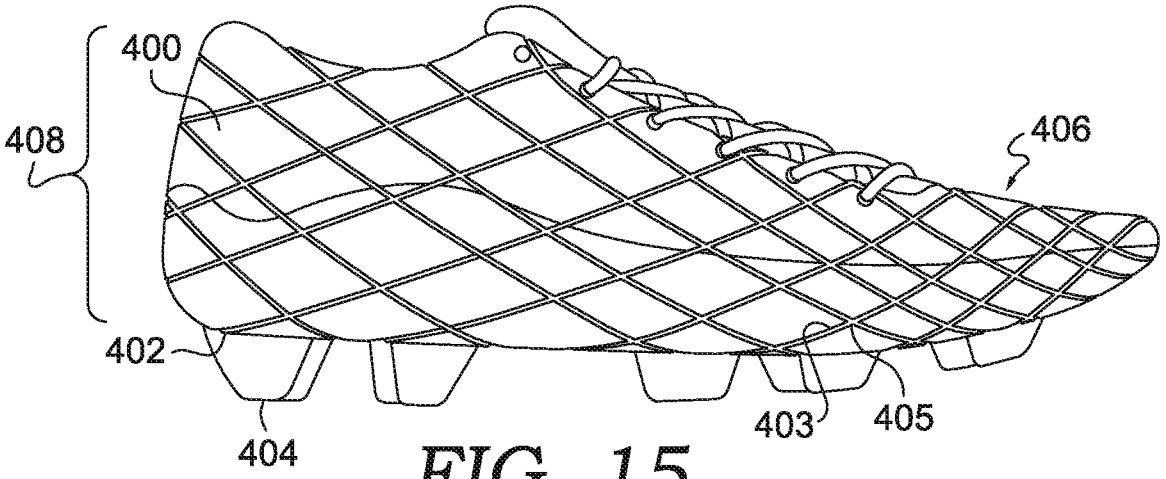
FIG. 15 depicts a side view of an exemplary braided article of footwear, in accordance with aspects herein.
Figure 16:
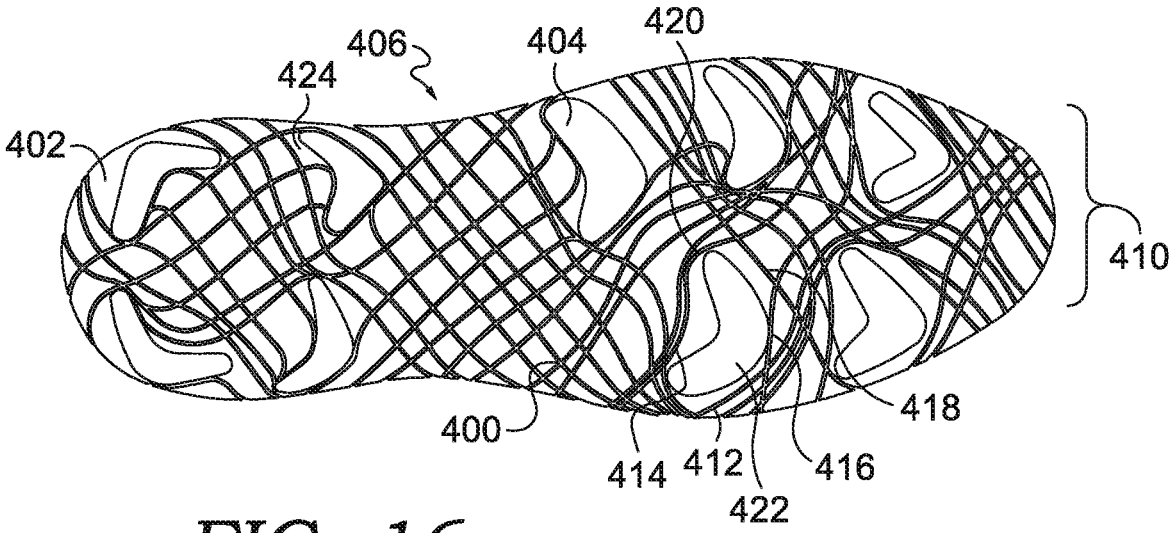
FIG. 16 depicts a bottom view of the braided article of footwear of FIG. 15, in accordance with aspects herein.

FIGS. 15-16 illustrate another aspect of the mechanical lock structure of a braided article of footwear 406. Like the aspects discussed above with respect to FIGS. 12-14, the braided article of footwear 406 includes a braided upper 400 and a midsole 402. In this aspect, the midsole 402 has a plurality of protruding studs 404 that are somewhat similar to those discussed with respect to FIGS. 5-10. FIG. 15 depicts a side view of the braided article of footwear 406. The braided upper 400 comprises a tubular braided structure 408 which receives the midsole 402 and the corresponding studs 404. Like FIGS. 12-14, the braided upper 400 may be braided with apertures 403 that interact with braid receiving features 405.

FIG. 16 illustrates the bottom view of the braided article of footwear of FIG. 15. The bottom surface 410 of the braided upper 400 has a braid design that is configured to engage the protruding studs 404 to provide 360-degree containment. For example, yarns 412, 414, 416, 418 and 420 on the bottom surface 410 of the braided upper 400, are configured to encircle protruding stud 422 and provide 360-degree containment of the protruding stud 422. In this aspect, the plurality of protruding studs 404 depicted are chevron shaped and configured in a specific pattern for the type of footwear shown. However, the plurality of protruding studs 404 may vary in shape and height with each protruding stud 404 maintaining a ground-contact surface.

From the foregoing, it will be seen that this invention is one well adapted to attain all the ends and objects hereinabove set forth together with other advantages that are obvious and are inherent to the structure. It will be understood that certain features and subcombinations are of utility and may be employed without reference to other features and subcombinations. This is contemplated by and is within the scope of the claims.

While specific elements are discussed in connection to one another, it is understood that any element provided herein is contemplated as being combinable with any other elements regardless of explicit provision of the same while still being within the scope provided herein. Since many possible aspects may be made of the disclosure without departing from the scope thereof, it is to be understood that all matter herein set forth or shown in the accompanying drawings is to be interpreted as illustrative and not in a limiting sense.

The invention claimed is:

1. An article of footwear including a braided structure, comprising:

a braided upper comprising a tubular braided structure, having an ankle opening, a toe end, a heal end opposite the toe end, an internal cavity, a bottom surface, an interior surface and an exterior surface, a braid configuration that defines a plurality of apertures that are located on the bottom surface of the braided upper and extend from the interior surface to the exterior surface, wherein at least a portion of the tubular braided structure is braided to surround a perimeter of each of the plurality of apertures; and a midsole comprising a toe end opposite a heel end, and a top planar surface opposite a bottom planar surface, the bottom planar surface abutting the interior surface of the braided upper, and a plurality of protruding studs extending below the bottom planar surface on at least a portion of the midsole, wherein at least one of the plurality of apertures encircles at least one of the plurality of protruding studs on the bottom planar surface to positively position the midsole with respect to the braided upper to provide a 360-degree containment of the at least one of the plurality of protruding studs, and further wherein each of the plurality of protruding studs comprises at least one ground-contact outer surface that extends below the exterior surface of the braided upper via the plurality of apertures.

2. The article of footwear of claim 1, wherein the at least a portion of the midsole is pre-molded with the plurality of protruding studs prior to being received by the plurality of apertures of the braided upper.

3. The article of footwear of claim 1, wherein the plurality of protruding studs extending below the bottom planar surface are positioned on one or more of the toe end of the bottom of the midsole, the heel end of the bottom of the midsole, and across an entire bottom surface of the midsole.

4. The article of footwear of claim 1, wherein the midsole comprises a co-molded midsole.

5. The article of footwear of claim 1, wherein the plurality of protruding studs are keyed such that at least a portion of each of the plurality of protruding studs intersects the braided upper at a corresponding aperture proximate a horizontal plane of the braided upper, wherein each corresponding aperture encircles each intersecting, protruding stud.

6. The article of footwear of claim 1 further comprising a sprayed outsole, said sprayed outsole comprising a spray component applied to both the plurality of protruding studs extending below the bottom planar surface of the midsole and the exterior surface of the braided upper.

7. The article of footwear of claim 1, wherein the midsole comprises one or more of a rubber material and an Ethylene-vinyl Acetate (EVA) material.

8. The article of footwear of claim 1, wherein the braided upper is formed from one or more of a nylon, carbon, polyurethane, polyester, cotton, aramid, polyethylene, and polypropylene yarns.

9. The article of footwear of claim 1, wherein the at least one ground-contact outer surface comprises a non-compressible material that maintains a first configuration upon ground contact.

10. The article of footwear of claim 1, wherein providing 360-degree containment comprises at least a portion of the braided structure abutting a circumference of each of the plurality of protruding studs.

11. The article of footwear of claim 1, wherein the plurality of protruding studs comprises at least one of a uniform shape, a uniform height, and a uniform width.

* * * * *